US006710762B1

(12) United States Patent
Hasegawa

(10) Patent No.: US 6,710,762 B1
(45) Date of Patent: Mar. 23, 2004

(54) PROJECTION TYPE DISPLAY

(75) Inventor: Kenzo Hasegawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/281,127

(22) Filed: Mar. 29, 1999

(30) Foreign Application Priority Data

Nov. 18, 1998 (JP) ..... 10-327796

(51) Int. Cl.[7] ..... G09G 3/36

(52) U.S. Cl. ..... 345/101; 345/210; 348/766; 353/57

(58) Field of Search ..... 345/101, 212, 345/7, 210; 361/687; 358/236; 349/10; 353/31, 52–61; 348/744, 748, 749, 750, 751, 761, 766

(56) References Cited

U.S. PATENT DOCUMENTS 5,838,386 A * 11/1998 Kim ..... 348/569
RE37,056 E * 2/2001 Wortel et al. ..... 348/761
6,364,492 B1 * 4/2002 Fujimori et al. ..... 353/119
6,394,608 B1 * 5/2002 Shiraishi et al. ..... 353/52

* cited by examiner

*Primary Examiner*—Dennis-Doon Chow
(74) *Attorney, Agent, or Firm*—Greer, Burns & Crain, Ltd.

(57) ABSTRACT

The present invention relates to a projection type projector using a liquid crystal light valve, and its object is to provide a projector type display improved in image quality, which a user side can easily maintain and analyze the causes at the time of trouble occurrence. The projection type projector comprises a liquid crystal light valve section 4 to modulate and emit an incident light from a lamp 2, and a projection lens 6 which modulates the incident light from the liquid crystal section 4. In addition, a control circuit 8 is structured to control a power supply 26 or on/off of the lamp 2, based on a measurement results of a temperature detecting devices 30 and 32, where the temperature detecting device 30 measures a temperature in the vicinity of the liquid crystal valve section 4 and the temperature detecting device 32 measures an external temperature of a body.

6 Claims, 18 Drawing Sheets

| UPPER ADDRESS | LOWER ADDRESS | | | | | | | | | | | | | | | |
|---|---|---|---|---|---|---|---|---|---|---|---|---|---|---|---|---|
| | 0 | 1 | 2 | 3 | 4 | 5 | 6 | 7 | 8 | 9 | A | B | C | D | E | F |
| 0 | 0 | 1 | 2 | 3 | 4 | 5 | 6 | 7 | 8 | 9 | A | B | C | D | E | F |
| 1 | G | H | I | J | K | L | M | N | O | P | Q | R | S | T | U | V |
| 2 | W | X | Y | Z | a | b | c | d | e | f | g | h | i | j | k | l |
| 3 | m | n | o | p | q | r | s | t | u | v | w | x | y | z | ア | イ |
| 4 | ウ | エ | オ | カ | キ | ク | ケ | コ | サ | シ | ス | セ | ソ | タ | チ | ツ |
| 5 | テ | ト | ナ | ニ | ヌ | ネ | ノ | ハ | ヒ | フ | ヘ | ホ | マ | ミ | ム | メ |
| 6 | モ | ヤ | ユ | ヨ | ラ | リ | ル | レ | ロ | ワ | ヲ | ァ | ャ | ッ | ョ | ュ |
| 7 | ゥ | ィ | ォ | * | + | ー | ／ | ～ | 『 | 』 | ・ | 。 | ( | ) | | |
| 8 | は | い | え | ? | | ■ | | | | | | | | | | |
| 9 | | | | | | | | | | | | | | | | |
| A | 内 | 部 | 外 | 温 | 度 | ℃ | を | し | て | 下 | | さ | 。 | 差 | 室 | 装 |
| B | 置 | 電 | 源 | 断 | 時 | 清 | 掃 | 交 | 換 | | | | | | | |
| C | | | | | | | | | | | | | | | | |
| D | | | | | | | | | | | | | | | | |
| E | | | | | | | | | | | | | | | | |
| F | | | | | | | | | | | | | | | | 空 |

FIG. 10

| ADDRESS | CHARACTER PICTURES | ACTUAL DATA (CHARACTER: COLOR) |
|---|---|---|
| A00 | RGB1 | 00011B4000 0002104000 00030B4000 0004014000<br>( R:G ) ( G:G ) ( B:G ) ( 1:G ) |
| A20 | RGB2 | 00011B4000 0002104000 00030B4000 0004024000<br>( R:G ) ( G:G ) ( B:G ) ( 2:G ) |
| A40 | VIDEO1 | 00011F4000 00022C4000 0003274000 0004284000<br>( V:G ) ( i:G ) ( d:G ) ( e:G )<br>0005324000 0006014000<br>( o:G ) ( 1:G ) |
| A60 | VIDEO2 | 00011F4000 00022C4000 0003274000 0004284000<br>( V:G ) ( i:G ) ( d:G ) ( e:G )<br>0005324000 0006014000<br>( o:G ) ( 2:G ) |
| A80 | TEMP MONITOR?<br>YES ■<br>NO | 00011D4000 0002284000 0003304000 0004334000<br>( T:G ) ( e:G ) ( m:G ) ( p:G )<br>0006164000 0007324000 0008314000 00092C4000<br>( M:G ) ( o:G ) ( n:G ) ( i:G )<br>000A374000 000B324000 000C354000 000D834000<br>( t:G ) ( o:G ) ( r:G ) ( ?:G )<br>010B224000 010C0E4000 010D1C4000 010E854000<br>( Y:G ) ( E:G ) ( S:G ) ( ■:G )<br>020B174000 020C184000<br>( N:G ) ( O:G ) |
| AD0 | EXT TEMP 25°C<br>INT TEMP 35°C | 00010E4000 0002214000 00031D4000 000A124000<br>( E:G ) ( X:G ) ( T:G ) ( I:G )<br>000B174000 000C1D4000 01041D4000 0105284000<br>( N:G ) ( T:G ) ( T:G ) ( e:G )<br>0106304000 0107334000 010B1D4000 010C284000<br>( m:G ) ( p:G ) ( T:G ) ( e:G )<br>010D304000 010E334000 0305021000 0306051000<br>( m:G ) ( p:G ) ( 2:G ) ( 5:G )<br>0307A51000 030C031000 030D051000 030EA51000<br>( °C:G ) ( 3:G ) ( 5:G ) ( °C:G ) |
| B20 | ROOM TEMP 25°C<br>UNIT TEMP 35°C | 00011B4000 0002324000 0003324000 0004304000<br>( R:G ) ( o:G ) ( o:G ) ( m:G )<br>00061E4000 0007314000 00082C4000 0109374000<br>( U:G ) ( n:G ) ( i:G ) ( t:G )<br>01011D4000 0102284000 0103304000 0104334000<br>( T:G ) ( e:G ) ( m:G ) ( p:G )<br>01061D4000 0107284000 0108304000 0106334000<br>( T:G ) ( e:G ) ( m:G ) ( p:G )<br>0301021000 0302051000 0303A51000 0306031000<br>( 2:G ) ( 5:G ) ( °C:G ) ( 3:G )<br>0307051000 0308A51000<br>( 5:G ) ( °C:G ) |

FIG. 11(a)

| | | | | | |
|---|---|---|---|---|---|
| B80 | CLEANING THE FILTER (INT/EXT DIF 20°C) | 00010C6000 | 00022F6000 | 0003286000 | 0004246000 |
| | | ( C:Y ) | ( l:Y ) | ( e:Y ) | ( a:Y ) |
| | | 0005316000 | 00062C6000 | 0007316000 | 00092A6000 |
| | | ( n:Y ) | ( i:Y ) | ( n:Y ) | ( g:Y ) |
| | | 0106374000 | 01072B4000 | 0108284000 | 010A0F4000 |
| | | ( t:G ) | ( h:G ) | ( e:G ) | ( F:G ) |
| | | 010B2C4000 | 010C2F4000 | 010D374000 | 010E284000 |
| | | ( i:G ) | ( l:G ) | ( t:G ) | ( e:G ) |
| | | 010F354000 | 02017C4000 | 0202124000 | 0203314000 |
| | | ( r:G ) | ( (:G ) | ( I:G ) | ( n:G ) |
| | | 0204374000 | 0205764000 | 02060E4000 | 02073B4000 |
| | | ( t:G ) | ( /:G ) | ( E:G ) | ( x:G ) |
| | | 0208374000 | 020A274000 | 020B2C4000 | 020C294000 |
| | | ( t:G ) | ( d:G ) | ( i:G ) | ( f:G ) |
| | | 0309026000 | 030A006000 | 030BA56000 | |
| | | ( 2:Y ) | ( O:Y ) | ( °C:Y ) | |
| C00 | CLEANING THE FILTER (INT/EXT DIF 35°C) | 00010C2000 | 00022B2000 | 0003242000 | 0004312000 |
| | | ( C:R ) | ( h:R ) | ( a:R ) | ( n:R ) |
| | | 00052A2000 | 00062C2000 | 0007312000 | 00092A2000 |
| | | ( g:R ) | ( i:R ) | ( n:R ) | ( g:R ) |
| | | 0106374000 | 01072B4000 | 0108284000 | 010A0F4000 |
| | | ( t:G ) | ( h:G ) | ( e:G ) | ( F:G ) |
| | | 010B2C4000 | 010C2F4000 | 010D374000 | 010E284000 |
| | | ( i:G ) | ( l:G ) | ( t:G ) | ( e:G ) |
| | | 010F354000 | 02017C4000 | 0202124000 | 0203314000 |
| | | ( r:G ) | ( (:G ) | ( I:G ) | ( n:G ) |
| | | 0204374000 | 0205764000 | 02060E4000 | 02073B4000 |
| | | ( t:G ) | ( /:G ) | ( E:G ) | ( x:G ) |
| | | 0208374000 | 020A274000 | 020B2C4000 | 020C294000 |
| | | ( t:G ) | ( d:G ) | ( i:G ) | ( f:G ) |
| | | 0309032000 | 030A052000 | 030BA52000 | |
| | | ( 3:R ) | ( 5:R ) | ( °C:R ) | |
| C80 | POWER OFF TEMP<br>EXT TEMP 20 °C<br>INT TEMP 60 °C<br>DIF 40 °C | 0001192000 | 0002322000 | 00033A2000 | 0004282000 |
| | | ( P:R ) | ( o:R ) | ( w:R ) | ( e:R ) |
| | | 0005352000 | 0007322000 | 0008292000 | 0009292000 |
| | | ( r:R ) | ( o:R ) | ( f:R ) | ( f:R ) |
| | | 000B1D2000 | 000C282000 | 000D352000 | 000E302000 |
| | | ( T:R ) | ( e:R ) | ( r:R ) | ( m:R ) |
| | | 01010E4000 | 0102214000 | 01031D4000 | 01051D4000 |
| | | ( E:G ) | ( X:G ) | ( T:G ) | ( T:G ) |
| | | 0106284000 | 0107354000 | 0108304000 | 010D024000 |
| | | ( e:G ) | ( r:G ) | ( m:G ) | ( 2:G ) |
| | | 010E004000 | 010FA54000 | 0201124000 | 0202174000 |
| | | ( O:G ) | ( °C:G ) | ( I:G ) | ( N:G ) |
| | | 0203ID4000 | 0205ID4000 | 0206284000 | 0207354000 |
| | | ( T:G ) | ( T:G ) | ( e:G ) | ( r:G ) |
| | | 0208304000 | 020D062000 | 020E002000 | 020FA52000 |
| | | ( m:G ) | ( 6:G ) | ( O:G ) | ( °C:R ) |
| | | 03010D4000 | 03012C4000 | 0303294000 | 030D042000 |
| | | ( D:G ) | ( i:G ) | ( f:G ) | ( 4:R ) |
| | | 030E002000 | 030FA52000 | | |
| | | ( O:R ) | ( °C:R ) | | |
| D20 | BLANK | 0000FF0000 | ~ | | |

FIG. 11(b)

FIG. 13

Cleaning
the Filter (Int/Ext dif
20 °C)

FIG. 14

Power off Temp
EXT Temp 20℃
INT Temp 60℃
Dif 40℃

PROJECTION TYPE DISPLAY

BACKGROUND OF THE INVENTION

1. Field of the Invention

The present invention relates to a projection type display using a light valve, particularly to the projection type display using a transmission type liquid crystal light valve.

2. Description of the Related Art

Among projection type displays using a valve for light modulation, a projection type display using a liquid crystal light valve, what is called, a liquid crystal projector can display a fine and large screen and therefore has a possibility to take the place of a display (CRT) for a home television or a personal computer (PC) in near future. Recently, along with an increase in display resolution required for the PC display, more fine and higher resolution for the liquid crystal projector is realized. The resolution proceeds from the conventional 640×480 dots (VGA) to 800×600 dots (SVGA) as a standard, and also to more fine 1024×768 dots (XGA) in future.

A schematic structure of the conventional liquid crystal projector 1 is briefly described with reference to FIG. 15. A projection optical system of the liquid crystal projector 1 comprises a lamp 2, a liquid crystal light valve section 4, and a projection lens 6. Although a diagram is omitted, the projection optical system also comprises a plurality of dichroic mirrors for separating light from the lamp 2 into three colors of red, green and blue, and a dichroic prism (or a plurality of dichroic mirrors) for synthesizing the three separated colors. The separated three colors respectively enter a liquid crystal light valve for each color provided in the liquid crystal light valve section 4, and are modulated according to an image signal, thereby emitting to the projection lens 6 after synthesized at the dichroic prism.

An image signal processing system in the liquid crystal projector 1 comprises a control circuit 8 to which a picture signal from the PC, the video equipment or the like inputs. The picture signal input to the control circuit 8 is converted to a predetermined voltage and supplied to each liquid crystal light valve in the liquid crystal light valve section 4 through a signal line 18. A driving voltage according to the picture signal is applied to each pixel of the liquid crystal light valve, thus allowing to obtain an image on a screen by changing transmissivity of each pixel in response to the picture signal and modulating the light from the lamp 2. Ordinary, a light source capable of producing a large amount of light such as a metal halide lamp and the like is used as the lamp 2. Hence, a large electric power is supplied from a power supply 26 through a power line 24 and the lamp 2 produces heat to a high temperature.

The heat produced at the lamp 2 increases an internal temperature of the liquid crystal projector 1 (body) by radiation or heat conduction through air. Also, a liquid crystal in a liquid crystal panel forming the liquid crystal light valve, and a polarizing plate and the like mounted on a surface of the liquid crystal panel increase the temperature for themselves by absorbing the light as well. The conventional liquid crystal projector 1 flows air around the liquid crystal light valve section 4 to maintain temperatures of these liquid crystal, the polarizing plate and the like within a predetermined specification temperature, for example, approximately 60 degrees. An intake fan 10 and an exhaust fan 12 are provided on the body, as illustrated, for performing a forced air cooling to make a air flow around the liquid crystal light valve section 4 by rotating these fans 10 and 12.

Further, a filter 14 is mounted on the air inflow side of the intake fan 10 to prevent an entry of dusts and the like.

Also, a temperature detecting device 30 is mounted on the liquid crystal light valve section 4 to measure temperatures of the liquid crystal panel and the polarizing plate. A detecting signal from the temperature detecting device 30 is output to the control circuit 8 via a signal line 16. The control circuit 8 compares the temperature detecting signal from the temperature detecting device 30 with a previously memorized reference value, thereby disconnecting the lamp 2 via a signal line 20 and the power supply 26 of the liquid crystal projector 1 via a signal line 22, when the temperature detecting signal exceeds the reference value. Here, the reference value of the temperature memorized in the control circuit 8 is described with reference to FIG. 16. A lateral axis in FIG. 16 shows a room temperature (° C.), while a vertical axis shows a temperature (° C.) detected based on the temperature detecting signal from the temperature detecting device 30. As shown in FIG. 16, it its understood that a temperature in the liquid crystal light valve 4 increases along with an increase in room temperature in spite of the enforced air cooling by the fans 10 and 12. Therefore, in the past, the reference value as an allowable temperature for the liquid crystal and the polarizing plate is adjusted to the specification temperature to protect the inner parts of the liquid crystal light valve. So, when the temperature in the liquid crystal light valve exceeds this reference value, the power supply 26 and the lamp 2 are disconnected.

Thus, the conventional liquid crystal projector 1 measures the temperature in the vicinity of the liquid crystal panel by means of the temperature detecting device 30 arranged at the liquid crystal light valve section 4 not to give a degradation or a malfunction to the liquid crystal or the polarizing plate by the heat or light from the lamp 2, thereby disconnecting the power supply 26 and the lamp 2 by comparing the previously memorized reference value with the measurement result.

Now, as shown in FIG. 16, though the temperature in the liquid crystal projector 1 varies depending on a temperature in atmosphere wherein the liquid crystal projector 1 is arranged, the temperature in the liquid crystal projector 1 also varies from other causes, such as the extent of clogging of the filter 14 in front of the intake fan 10. In short, some causes exist until the measurement result of the temperature detecting device 30 reached the above reference value. However, under a temperature control of the above-mentioned conventional liquid crystal projector, only if the temperature of the inner parts in the liquid crystal light valve section 4 exceeds the reference value or not is judged, thus preventing the temperature variation on the way to reach the reference temperature from being grasped. Therefore, it has a problem that it is difficult to find out the causes at the time of disconnection of the power supply 26 or the lamp 2 of the liquid crystal projector from the side of users.

Also, the conventional liquid crystal projector 1 has another problem that maintenance for easily discovering preventing the efficiency deterioration of the intake fan 10 caused by the clogging of the filter 14, which is one of the causes by which the temperature of the inner parts in the liquid crystal light valve section 4 exceeds the reference temperature, is difficult.

The conventional liquid crystal projector 1 has a further problem that image quality degrades. Because even if a predetermined voltage is applied to the liquid crystal to gain a predetermined gradation in a half tone display, when the temperature of the liquid crystal panel in the liquid crystal light valve section 4 changes, transmissibity of the liquid crystal panel changes depending on it, so that the reproducibility of the half tone differs depending on the temperature.

SUMMARY OF THE INVENTION

An object of the present invention is to provide a projector type display which can be easily maintained on the user side.

Above objects are achieved by a projection type display having a light valve for modulating and emitting an incident light from a light source, a projection lens for enlarging and projecting the emitted light form the light valve, and a body at least containing the light valve. The projection type display comprises temperature measurement unit for measuring at least a temperature in the vicinity of the light valve and an external temperature of the body and a control system to control at least on/off of a power supply of the light source based on a temperature measured by the temperature measurement unit.

One of the aspects in the projection type display of the present invention, the temperature measurement unit at least comprises a first temperature detecting device to measure the temperature in the vicinity of the light valve and a second temperature detecting device to measure the external temperature in the vicinity of the body.

In addition, the projection type display comprises an intake fan for injecting air into the body, and the second temperature detecting device is arranged in the vicinity of the intake fan.

Further, the projection type display provides a filter on an outside air intake side of the intake fun, and the second temperature detecting device measures a temperature in the vicinity of the filter.

Furthermore, in the projection type display of the present invention, the control system comprises an estimation processing section which measures a temperature difference between the temperature in the vicinity of the light valve and the external temperature in the vicinity of the body based on measurement results of the first temperature detecting device and the second temperature detecting device, and presumes the extent of the dirt of the filter based on the temperature difference. According to the present invention, the user side can easily discover the clogging of the filter, so that an easy maintenance can be realized.

In the projection type display described above, the control system comprises a memory section to memorize a temperature measured by the temperature measurement unit immediately before a disconnection of the power supply. According to the present invention, since not only the internal temperature of the body but also the external temperature of the body are measured and memorized, the cause of the power disconnection is easily judged whether it is due to the increase in external temperature of the display or due to the malfunction of fan stop or reduction of the rotating speed, thus making it easy to analyze the causes at the time of the trouble occurrence.

Also, the control system comprises an on-screen display control circuit, and supplies a modulation signal overlapping a predetermined image on a picture signal to the light valve. Because the present invention comprised such a structure, various information can be displayed overlapping on the screen on which the picture is projected. Particularly, because the time of filter cleaning and filter change can be displayed, an easy maintenance by the user can be realized.

Further, above objects are achieved by the projection type display having a light valve for modifying and emitting an incident light from a light source, a projection lens for enlarging and projecting an emitted light from the light valve, and a body at least containing the light valve. The projection type display comprises temperature measurement unit for measuring at least a temperature in the vicinity of the light valve and a control system for shifting a level of a modulating signal input to the light valve based on the temperature measured by the temperature measurement unit. According to the structure of the projection type display of present invention, even if the gradation of the picture by the light emitted from the light valve is under the situation to receive the influence of the internal temperature of the body, the level of the modulation signal can be shifted in response to the temperature change, thus being capable for projecting a picture in high quality which prevents the deterioration in image quality.

Further, in the projection type display, the light valve comprises a liquid crystal panel which modulates the incident light by a picture signal and emits the modulated light.

BRIEF DESCRIPTION OF THE DRAWINGS

FIG. 10 is a diagram showing an example of a structure of a character ROM 64 of the OSD-IC62 in the liquid crystal projector 1 according to an embodiment of the present invention.

FIG. 13 is a diagram showing an example of an on-screen display of the liquid crystal projector 1 according to an embodiment of the present invention.

FIG. 14 is a diagram showing an example of an on-screen display of the liquid crystal projector 1 according to an embodiment of the present invention.

FIG. 16 is a diagram showing a relationship between a detecting temperature based on a temperature detecting device of the conventional liquid crystal projector and a room temperature.

DESCRIPTION OF THE PREFERRED EMBODIMENTS

Figure 1:
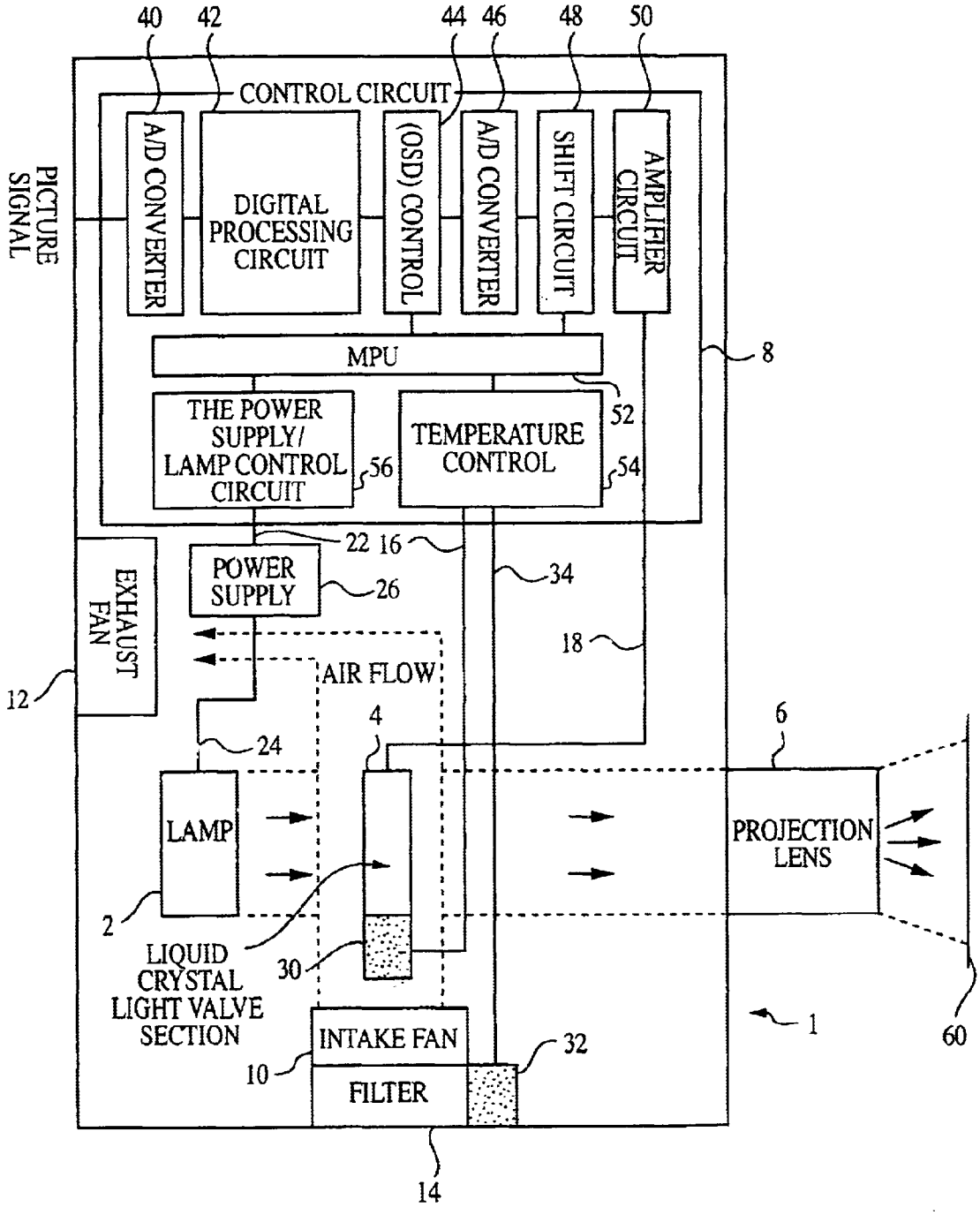
FIG. 1 is a diagram showing a schematic structure of a projection type display according to an embodiment of the present invention.

A projection type display according to an embodiment of the present invention is describing with reference to FIG. 1 through FIG. 14. First, a schematic structure of the projection type display according to the embodiment of the present invention is described with reference to FIG. 1. A liquid crystal projector 1 using a transmission type liquid crystal light valve is exemplified and described as the projection type display according to the embodiment. A projection optical system of the liquid crystal projector 1 has a lamp 2 using, for example, a metal halide lamp and the like. The projection optical system, though a diagram is omitted, has a shaping optical system to shape white light emitted from a lamp 2 and also a plurality of dichroic mirrors to separate the shaped white light into three colors of red, green and blue.

Further, the projection optical system has a liquid crystal light valve section 4 which comprises three liquid crystal light valves to which each color of red, green and blue separated at the dichroic mirrors inputs respectively. The liquid crystal light valve has a liquid crystal panel to drive each of a plurality of pixels arranged in the shape of matrix in response to an image signal and a polarizing plate mounted on the surface of the liquid crystal panel. Light entering to the liquid crystal light valve is emitted after modulated by the image signal. Also, the projection optical system, though a diagram is omitted, has a dichroic prism (or a plurality of dichroic mirrors) to synthesize the three colors separated at the liquid crystal light valve section 4 and emitted therefrom, and a projection lens 6 to project the synthesized light on a screen.

The image signal processing system of the liquid crystal projector 1 has a control circuit 8 to which a picture signal from PC or video equipment or the like inputs. The control circuit 8 has an A/D converter 40 to which the picture signal from the PC or the video equipment or the like inputs. The control circuit 8 also has a digital processing circuit 42 to which the picture signal converted from analog to digital at an A/D converter 40 is input. The digital processing circuit 42 performs a separation/sequencing according to the picture signal. An output signal of the digital processing circuit 42 is converted from digital to analog at a D/A converter 46 through an on-screen display (OSD) control circuit 44. The OSD control circuit 44 overlaps a desired character or an image on the digital picture signal from the digital processing circuit 42, and outputs them to the D/A converter 46. The control circuit 8 also has a shift circuit 48 which inputs an analog signal from the D/A converter 46 and shifts the voltage level of the analog signal as much as predetermined amount. An analog signal the voltage level of which is converted at the shift circuit 48 is input to an amplifier circuit 50, converted to a predetermined voltage and supplied to each liquid crystal light valve in the liquid crystal light valve section 4 through a signal line 18. Thus, an image can be obtained on the screen 60 by applying a driving voltage to each pixel of the liquid crystal light valve corresponding to the picture signal and by converting the light from the lamp 2 which passes through each pixel.

Also, a microprocessor (MPU) 52 is provided at the control circuit 8 to control the OSD control circuit 44 and the shift circuit 48 therewith. A power supply/lamp control circuit 56 to control the lamp 2 and a power supply 26, and a temperature control circuit 54 to detect temperatures from a plurality of temperature detecting devices 30 and 32 provided in the liquid crystal projector are provided at this control circuit 8. The power supply/lamp control circuit 56 and the temperature control circuit 54 are controlled by the MPU 52 as well.

A light source capable of producing a large amount of light, such as a metal halide lamp and the like, is ordinary used as the lamp 2 of the projection optical system. Therefore, a large electric power is supplied from the power supply 26 through a power line 24, so that the lamp 2 generates a heat to a high temperature. The heat generated in this lamp 2 increases an internal temperature of the liquid crystal projector 1 by radiation or heat conduction through the air. The liquid crystals in the liquid crystal panels of a plurality of the liquid crystal light valves forming the liquid crystal light valve section 4 and the polarizing plate mounted on the surface of the liquid crystal panels and the like also increase the temperature for themselves by absorbing the light. The liquid crystal projector 1 according to this embodiment flows air around the liquid crystal light valve section 4 to maintain the temperature of these liquid crystals and polarizing plates within the specification temperature (for example, approximately 60°). An intake fan 10 and an exhaust fan 12 are provided on the body of the liquid crystal projector 1, as illustrated, and execute a forced air cooling forming an air flow around the liquid crystal light valve section 4 by rotating these fans 10 and 12. A filter 14 to prevent the entrance of dusts is also mounted on the air inflow side of the intake fan 10.

Further, on the liquid crystal projector 1 according to the embodiment, the temperature detecting device 30 to measure the temperature of the liquid crystal panel and the polarizing plates is mounted on the liquid crystal light valve section 4, while the temperature detecting device 32 is also arranged adjacent to the filter 14 provided on the air inhalation side of the intake fan 10. The temperature detecting device 30 is arranged adjacent to the liquid crystal panels and detects the temperature of the liquid crystal panels, thereby transmitting the temperature data of the liquid crystal panels to the temperature control circuit 54 through a signal line 16. The temperature detecting device 32 detects a temperature (substantially being equal to a room temperature) of wind flowing from the external of the body of the liquid crystal projector 1 and transmit the external temperature data of the body to the temperature control circuit 54 through a signal line 34. The temperature control circuit 54 reads both temperature data, and informs the difference of values among them and each measurement value to the MPU 52 which controls the whole control circuit 8. Based on these values, the MPU 52 in the control circuit 8 disconnects the power supply 26 or the lamp 2 by controlling the power supply/lamp control circuit 56, or sets the shift circuit 48 and the OSD control circuit 44.

For example, the control circuit 8 compares the temperature detecting signal from the temperature detecting device 30 with the reference value previously memorized. And, the control circuit 8 controls the power supply 26 through a signal line 22 when the temperature detecting signal exceeds the reference value, stops the supply of power from the power supply 26 to the lamp 2 to extinguish the lamp 2, or controls the power supply 26 to disconnect the supply of power supplied to the whole liquid crystal projector 1 through the signal line 22.

Figure 2:
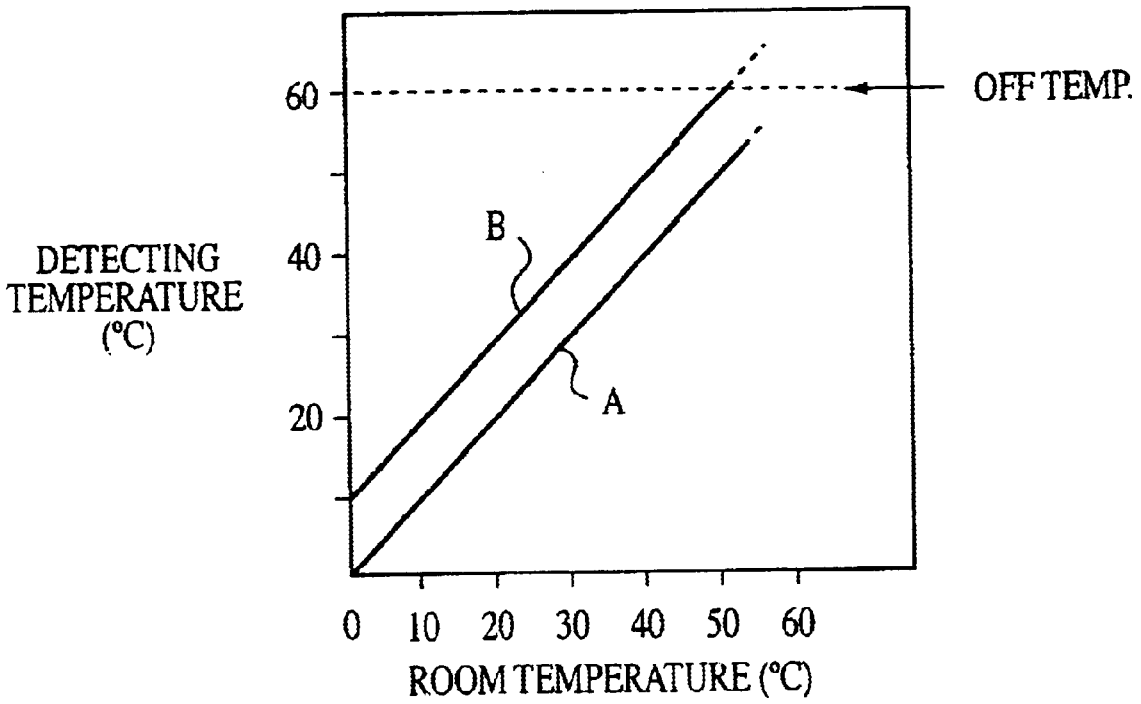
FIG. 2 is a diagram showing a relationship between a room temperature and the detection result of a temperature detecting device 30 in a projection type display according to an embodiment of the present invention.

This reference value is described with reference to FIG. 2. In FIG. 2, a lateral axis indicates a room temperature (° C.) and a vertical axis indicates a temperature (° C.) detected based on the temperature detecting signals from the temperature detecting devices 30 and 32. In FIG. 2, (A) indicates a room temperature detected by the temperature detecting device 32, and (B) indicates a temperature on the liquid crystal panel side detected by the temperature detecting device 30. As shown in FIG. 2, in spite of the forced air cooling by the fans 10 and 12, the temperature in the liquid crystal light valve section 4 increases along with the increase of the room temperature, always maintaining the temperature on the liquid crystal panel side approximately 10° C. higher than the room temperature. Therefore, to protect the inner parts of the liquid crystal light valve, an allowable temperature is adjusted to a specification temperature of these liquid crystals and polarizing plates, and the power supply 26 is disconnect to also disconnect the lamp 2 when this exceeds the specification temperature.

Figure 3:
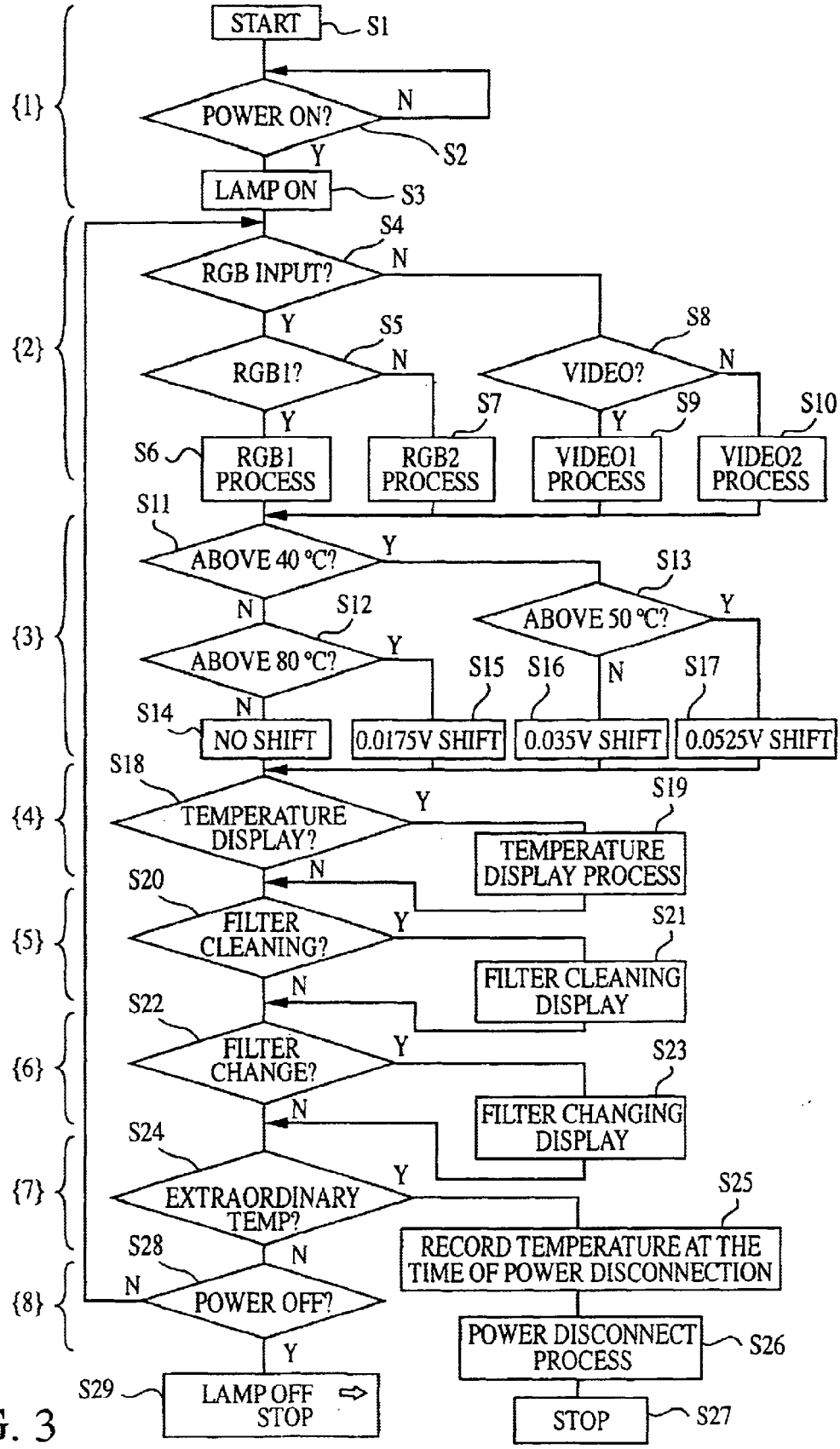
FIG. 3 is a flow chart showing an operating procedure of a liquid crystal projector 1 according to an embodiment of the present invention.

An operation of the liquid crystal projector 1 according to the having the above structure is described hereinafter. FIG. 3 is a flow chart showing an operation procedure of the liquid crystal projector 1 according to the embodiment. Each of numbers {1}~{8} refers each operation group in a series of flows on the left side of this flow chart. First, an operation of a power-on process {1} is described. The MPU 52 keeps watching the state of the power supply in the loop state (steps Si and S2) until a power switch (SW) of the liquid crystal projector 1 is powered on by means of a control panel or an attached remote control unit. When the SW is powered on, the MPU 52 senses, leaves this loop state, and start the power supply to connect the lamp 2. At the same time, the MPU 52 initializes a variety of circuits and the like in the display as well as initializing the memories and so on to clear (step S3). In this manner, the liquid crystal projector 1 starts to display.

Hereinafter, processes of an input switching process {2}, a liquid crystal applied voltage control process {3}, a temperature display process {4}, a filter cleaning process {5}, a filter change process {6}, an extraordinary temperature monitor process {7}, and a power-off monitor process {8} are performed repeatedly. Each operation of the above {2}~{8} is described in detail below.

First, in the input switching process {2}, the picture signal inputting to the A/D converter 40 of the control circuit 8 is judged whether the picture signal is a RGB signal or not (step S4). When the picture signal is the RGB signal, it is also judged whether the picture signal is a RGB1 signal or a RGB2 signal (step S5). If the input picture signal is the RGB1 signal, a predetermined RGB1 process is executed within the control circuit 8 (step S6), and if the picture signal is the RGB2 signal, a predetermined RGB2 process is executed in the control circuit 8 (step S7). On the other hand, at the step S4, when the picture signal is judged as not the RGB signal, it is judged whether it is a video1 signal or not (step S8). If the input picture signal is the video1 signal, a predetermined video1 process is executed in the control circuit 8 (step S9). If the picture signal is a video2 signal, a predetermined video2 process is executed in the control circuit 8 (step S10). Thus, in the input switching process {2}, the input signal always monitors which input signal among the RGB1, RGB2, video1 or video2 is selected at the control panel or the remote control unit.

Figure 4:
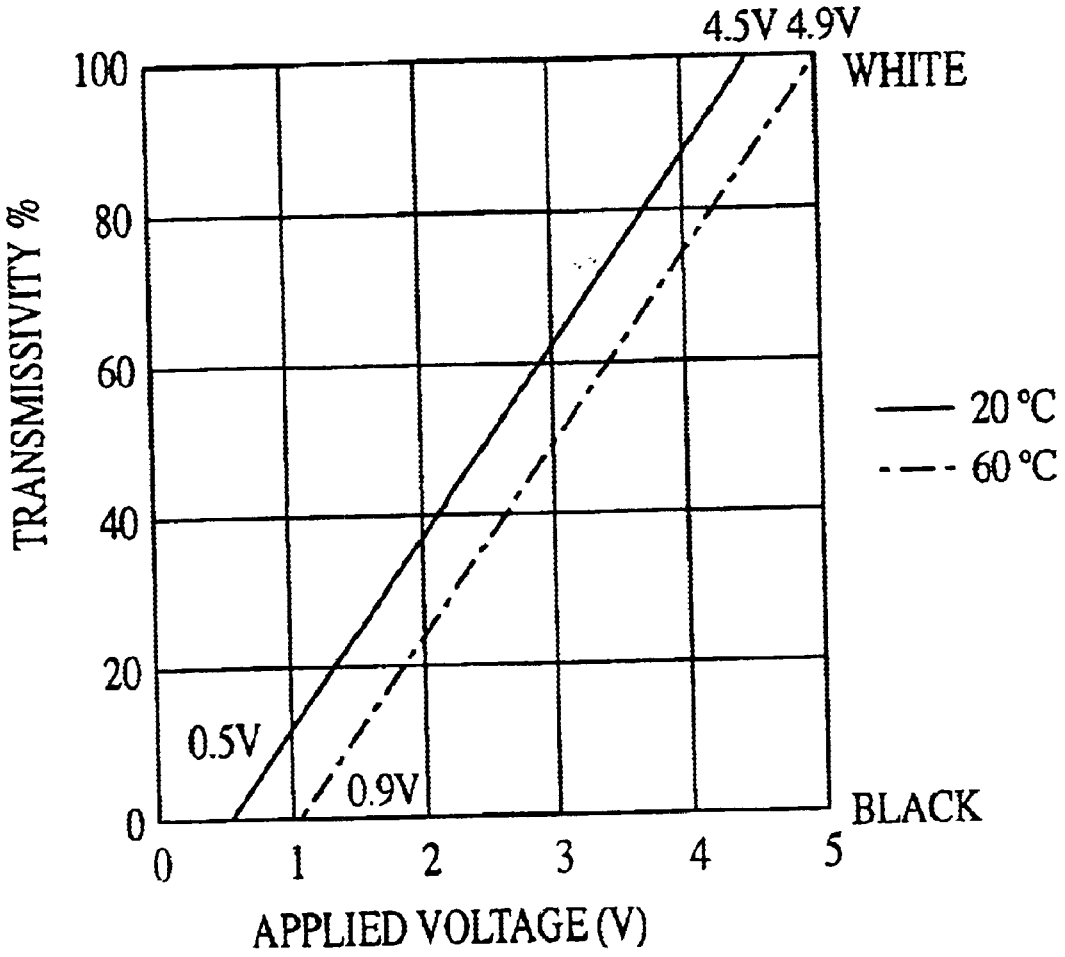
FIG. 4 is a diagram showing a relationship between an applied voltage and transmissivity characteristic the general liquid crystal panel has.

Next, An operation procedure of the liquid crystal applied voltage control process {3} is described. First, a relationship between an applied voltage and a transmissivity characteristic, which a general liquid crystal panel has, is shown in FIG. 4. In FIG. 4, a lateral axis indicates the supplied voltage (V) to the liquid crystal, while a vertical axis indicates the transmissivity (%) of the liquid crystal panel. Also, in FIG. 4, data shown by a solid line is when the temperature of the liquid crystal panel is 20° C., and data shown by an alternate long and short dash line is when the temperature of the liquid crystal panel is 60° C. As shown by two data in FIG. 4, the relationship between the applied voltage and the transmissivity characteristic has a temperature dependency. In short, when the temperature of the liquid crystal panel is 20° C. and the liquid crystal applied voltage is below 0.5 V, the transmissivity is 0% and black is displayed, and the transmissivity is 100% and white is displayed when the liquid crystal applied voltage is above 4.5 V. And, when the applied voltage is in the range of 0.5 to 4.5 V, a half tone is displayed. On the other hand, when the temperature of the liquid crystal panel is 60° C. and the liquid crystal applied voltage is below 0.9 V, the transmissivity is 0% and black is displayed, and the transmissivity is 100% and white is displayed if the liquid crystal applied voltage is above 4.9 V. In addition, when the applied voltage is in the range of 0.9 to 4.9 V, a half tone is displayed.

Therefore, as is clear from FIG. 4, when the temperature of the liquid crystal panel is 20° C. and 60° C., for example, at approximately 50% of the transmissivity, the voltage shifts by 0.4 V. In short, the temperature dependency ratio is 10 mv/° C. So that, at the half tone display, for example, even if a voltage equal to 3 V is applied to the liquid crystal, the transmissivity shifts by 10% at the liquid crystal panels equal to 20° C. and 60° C., therefore the reproduction of the half tone differs significantly by the temperature.

In this embodiment, the temperature dependency characteristic of this liquid crystal panel is compensated by the MPU 52 using the temperature control circuit 54 and the shift circuit 48, based on the detection result from the temperature detecting device 30. For example, assuming the level of the picture signal is 0.7 V, and the liquid crystal applied voltage to the liquid crystal panel equal to 20° C. is in the range of 0.5 to 4.5 V (range: 4 V), a gain of an amplifier circuit 50 equal to 5.714286 (=4/0.7) is obtained. Therefore, assuming an input voltage is X (V) and an output voltage is Y (V), Y is equal to 5.714286×X+0.5.

When the temperature of the liquid crystal panel changes from 20° C. to 60° C., the shift amount of the applied voltage of the liquid crystal panel to obtain the same transmissivity is 1.4 V. So that, the change amount of the shift amount per 1° C. equal to 0.0017499 V (=0.07/40) is obtained dividing a value of 0.07 V (=0.4/5.714286), which results from dividing the shift amount by the gain of the amplifier circuit 50, by the temperature difference 40. Therefore, the shift amount SV can be calculated by SV=0.0017499(t−20) and a display independent from the temperature is possible if the shift amount is changed for every temperature (t). It should be noted that an input of the temperature (t) to the shift circuit 48 can be in either form of the analog voltage or the digital input because the temperature (t) of the liquid crystal panel is detected at the temperature detecting device 30. With an example in FIG. 4, though the liquid crystal panel of, what is called, a normally black type displaying black in the sate wherein no voltage is applied to the liquid crystal is described. However, this embodiment can be applied to the liquid crystal panel of, what is called, a normally white type displaying white in the state wherein no voltage is applied to the liquid crystal.

The liquid crystal applied voltage control process {3} is described returning to the operation procedure in FIG. 3. First, it is judged to which level the panel temperature belongs among the following four levels, below 30° C., between 30~40° C., between 40~50° C., or above 50° C. So, it is judged whether the temperature of the liquid crystal panel is above 40° C. or not (step S11) monitoring the detection result of the temperature detecting device 30 by the temperature control circuit 54. When the temperature of the liquid crystal panel is above 40° C., it is then judged whether the temperature of the liquid crystal panel is above 50° C. or not (step S13). When the temperature of the liquid crystal panel is judged to be above 40° C., 0.0525 V is set at the shift circuit 48 as the shift amount SV to shift the picture signal (step S17). When the temperature of the liquid crystal panes is judged to be below 50° C., 0.035 V is set to the shift circuit 48 as the shift amount SV to shift the picture signal (step S16).

Meanwhile, when the temperature of the liquid crystal panel is judged to be below 40° C. at the step S11, it is further judged whether the temperature of the liquid crystal panel is above 30° C. or not (step S12). When the temperature of the liquid crystal panels is judged to be above 30° C., 0.0175 V is set to the shift circuit 48 as the shift amount SV to shift the picture signal (step S15). When the temperature of the liquid crystal panel is judged to be below 30° C., 0 V (no shift amount exists) is set to the shift circuit 48 as the shift amount SV to shift the picture signal (step S14). In this way, the half tone display in accurately response with the input picture signal without depending on the temperature of the liquid crystal panel. In the above example, the temperature change of the liquid crystal panel is divided into 4 levels with 10° C. interval respectively. However, it is possible to set the temperature ranges smaller or change the shift amount continuously.

Next, an example of the structure of the shift circuit 48 used for the liquid crystal applied voltage control process {3} is described with reference to FIG. 5. Here, as has been mentioned hereinbefore, the shift circuit 48 to set the shift amount SV by dividing the temperature range of the liquid crystal panel into 4 levels with 10° C. interval respectively is described. The shift circuit 48 has a resistive partial potential circuit to obtain four kinds of output voltages by means of six resistances 80, 82, 84, 86, 88 and 90. A voltage equal to 3 V is applied in parallel to the three resistances 80, 82, and 84 and each value R1 of the resistances is equal to 10 KΩ. The resistance 80 is connected to the resistance 86 (R2=58.67Ω) and grounded to GND (ground). The resistance 82 is connected to the resistance 88 (R3=118.04Ω) and grounded to the GND (ground). In addition, the resistance 84 is connected to the resistance 90 (R4=178.11Ω) and connected to the GND (ground).

In such a structure, a voltage supply terminal 94 supplying 0.0175 V is formed diverging from a connection line connecting the resistances 80 and 86, a voltage supply terminal 96 supplying 0.035 V is formed diverging from a connection line connecting the resistances 82 and 88, and a voltage supply terminal 98 supplying 0.0525 V is formed diverging from a connection line connecting the resistances 84 and 90. Also, a voltage supply terminal 95 supplying 0 V is formed from the GRD.

Based on the selection signal from the MPU 52, a selector switch 100 selectively connectable to either of these four voltage supply terminals 92~98 is provided. The selector switch 100 is connected to a non-inversion input terminal (+terminal) of a buffer operation amplifier 102. An output terminal of the buffer operation amplifier 102 is connected to a resister 104 and an inversion input terminal (−terminal) of the buffer operation amplifier 102 as well. The resister 104 is connected in parallel with a following resister 106 and an inversion input terminal of a shifting operation amplifier 112. The downstream direction side of current of the resistance 106 is connected to an output terminal of the shifting operation amplifier 112. Further, the picture signal inputs to a non-inversion input terminal of the shifting operation amplifier 112 via a resister 108. It should be noted that a resister 110 is connected between the non-inversion input terminal of the shifting operation amplifier 112, the resister 108, and the GRD.

In such a structure, the shift amount for each level is formed by the resistive partial potential. For example, in case the shift amount SV equal to 0.0175 V is formed, SV=3/(R1+R3)×R3=0.0175 V where R3 is assumed to be 58.67Ωand R1 is assumed to be 10 KΩ. Thus, after forming the shift amount for four levels, it is calculated in the MPU 52 from the measurement result of the temperature detecting device 30 where the temperature of the liquid crystal panel is among the four levels of below 30° C., 30~40° C., 40~50° C. and above 50° C. And, the selection signal is transmitted from the MPU 52 to input the shift voltage SV to the non-inversion input terminal of the buffer operation amplifier 102 by means of the selector switch (relay/analog switch, etc.) The same voltage value as the shift voltage SV is output to the output terminal of this buffer operation amplifier 102, and input on the inversion input terminal side of the shifting operation amplifier 112 in the next stage, thus obtaining an output voltage from the output terminal side of the shift operation amplifier 112, which applies a shift voltage SV on the picture signal.

Figure 5:
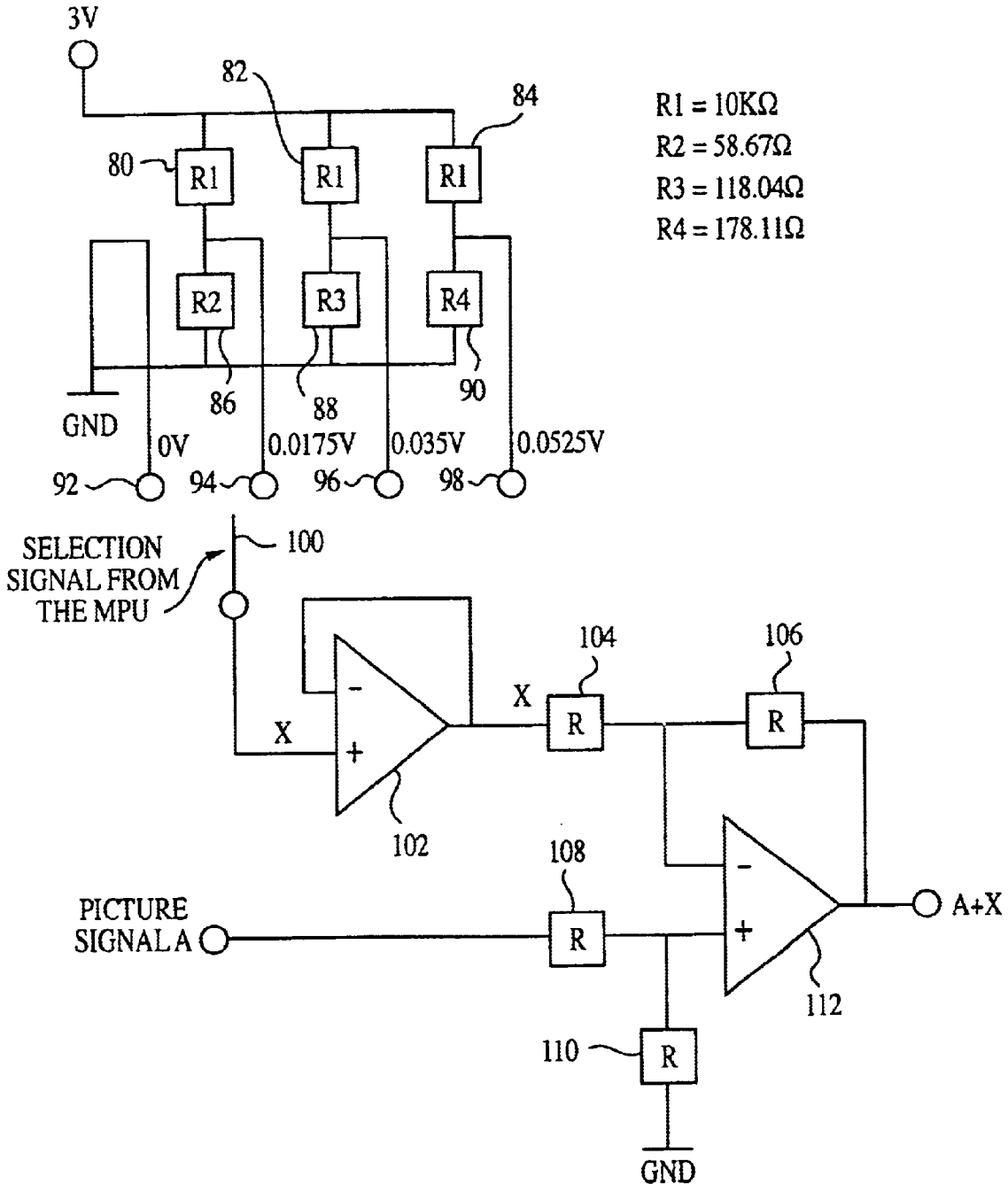
FIG. 5 is a diagram showing an example of a shift circuit 48 used during a liquid crystal applied voltage control procedure of the liquid crystal projector 1 according to an embodiment of the present invention.
Figure 6:
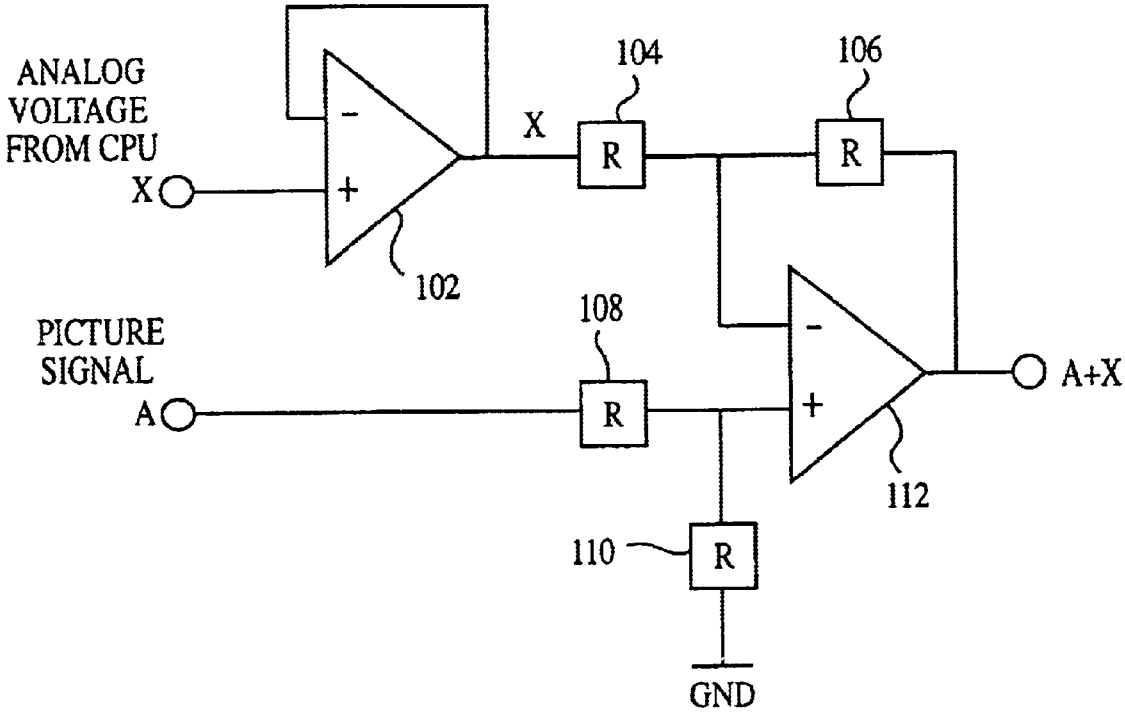
FIG. 6 is a diagram showing an example of a deformation of the shift circuit 48 shown in FIG. 5.

Also, a structure can be made such as that in FIG. 6 as a deformation example of the shift circuit 48 shown in FIG. 5. FIG. 6 shows the shift circuit 48 which can continuously change the shift voltage SV instead of a step-wise change. At the MPU 52, the shift voltage SV is calculated corresponding to the temperature of the liquid crystal panel, and the shift voltage SV of the analog voltage is input to the non-inversion input terminal of the buffer operation amplifier 102 via a D/A converter omitted in the diagram. Since the subsequent stage from the output side of the buffer operation amplifier 102 has the same structure as the FIG. 5, description is omitted.

By arranging the shift circuit 48 having a similar structure described above in the control circuit 8, even if the temperature of the liquid crystal panel in the liquid crystal projector section 4 changes by the change of the temperature in the liquid crystal projector 1, the picture with a high display quality can be projected on the screen 60 maintaining an accurate gradation display.

Figure 7:
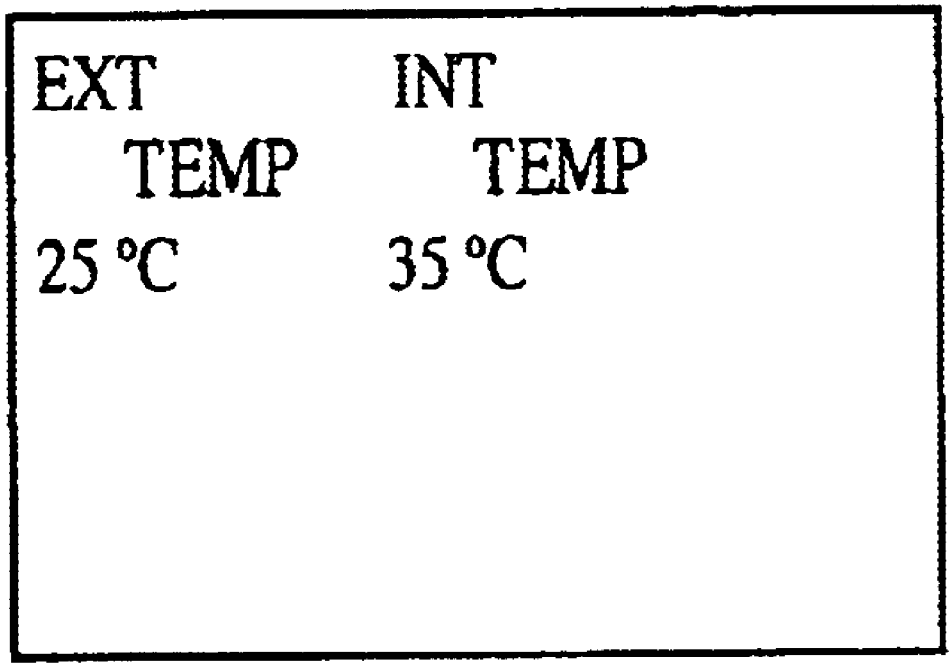
FIG. 7 is a diagram showing an example of an on-screen display of the liquid crystal projector 1 according to an embodiment of the present invention.
Figure 8:
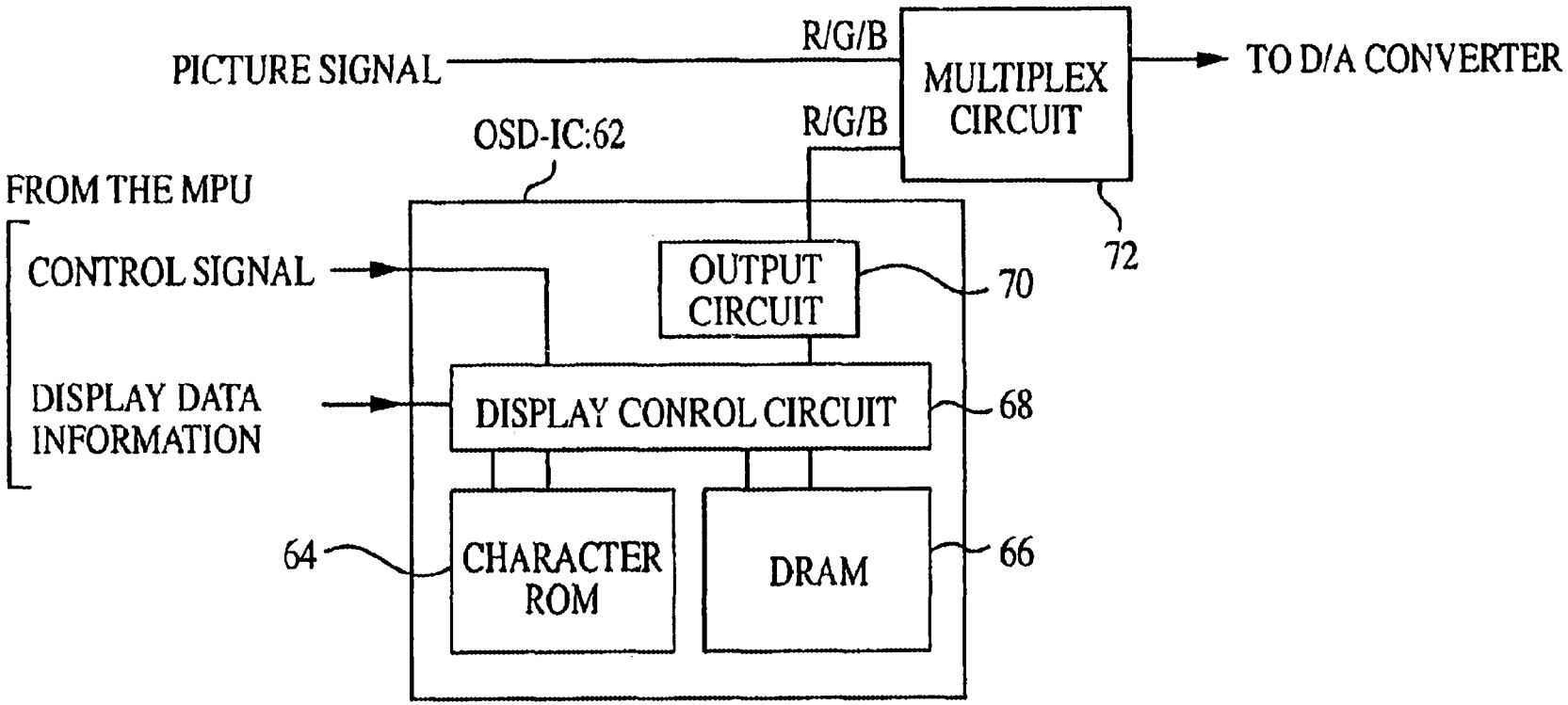
FIG. 8 is a diagram showing a general structure of an OSD control circuit 44 used during a temperature display procedure of the liquid crystal projector 1 according to an embodiment of the present invention.

Next, the procedure of the temperature display process {4} in FIG. 3 is described. It is judged whether the temperature display is made or not at the step S18, and when the user's instruction is sent from the control panel or remote control unit, the temperature display process is performed at the step S19. The values of the temperature detection from the temperature detecting devices 30 and 32 incorporated in the liquid crystal projector 1 are projected on the screen 60 together with the picture signal, and the operation circumstance and operation state concerning to the temperature of the liquid crystal projector 1 can be confirmed by the user. In this way, the user can set an accurate operation circumstance (for example, to set a liquid crystal projector 1 at a place where the room temperature is lower, and so on). The OSD control circuit 44 is used for overlapping and displaying the values of the temperature detection of the temperature detecting devices 30 and 32 together with the picture signal. FIG. 7 shows an example of the on-screen display. In FIG. 7 shows an example wherein "EXT Temp 25° C." and "INT Temp 35° C." are displayed overlapping on the picture projected on the screen 60. There are various forms to display and "Room Temp 25° C." or "Unit Temp 35° C." is of course allowed.

Next, an example of the general structure of the OSD control circuit 44 used in the temperature display process {4} mentioned above is described with reference to FIG. 8. Roughly classifying, the structure of the OSD control circuit 44 consists of the OSD-IC62 which generates a overlapped signal overlapped on the picture signal and a multiplex circuit 72 which multiplies the generated overlapping signal to the picture signal. The multiplex circuit 42 is provided for each color of red (R), green (G) and Blue (B).

Though there are various kinds of OSD-IC's 62, a general OSD-IC 62 providing a character ROM 64 and a DRAM 66, and having a display control circuit 68 and an output circuit 70 therein is described here. A control signal and display data information from the MPU 52 are input to the display control circuit 68 of this OSD-IC 62. The control signal from the MPU 52 is used for inputting display data displayed on the screen 60 to the internal DRAM 66. The display data information from the MPU 52, for example, is character information to overlap on the picture signal. In addition, control signals such as a vertical synchronous signal (VS) and a horizontal synchronous signal (HS) to synchronize with the picture signal are input from the MPU 52 to the display control circuit 68.

Figure 9:
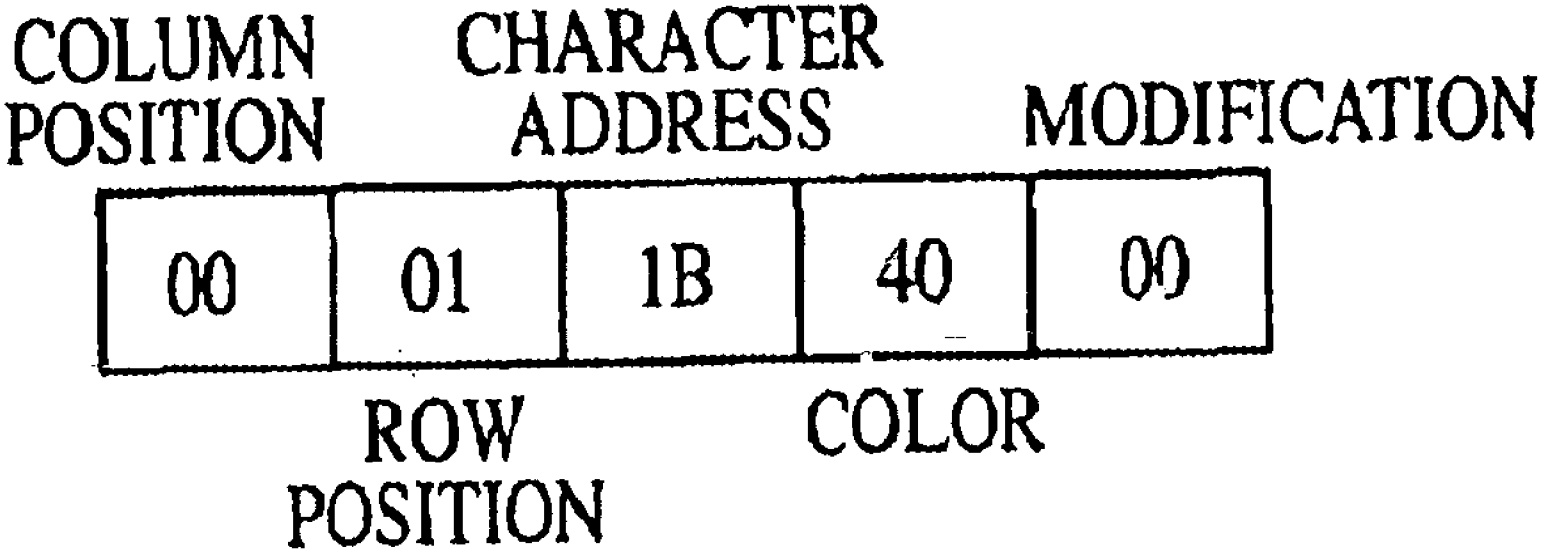
FIG. 9 is a diagram showing a schematic example of display data information transmitted from a MPU 52 to an OSD-IC62 in the liquid crystal projector 1 as serial data according to an embodiment of the present invention.

Here, a method to overlap the character together with the image on the screen by the OSD control is briefly described. First, FIG. 9 describes a simplified example of the display data information transmitted as serial data from the MPU 52 to the OSD-IC 62. As shown in FIG. 9, the display data information consists of totally 10 bytes of data which are divided into 5 two-byte data (8 bits). Each of them refers, from the head (left side in FIG. 9), a column position of the DRAM 66 having a capacity of approximately 20 rows×16 columns, a row position of the DRAM 66, the character position of the character ROM 64 in the OSD-IC 62, a color of the character, and a modification of a shadowing or a blinking of the character. In this example, the column position of the DRAM 66 is (00), the row position of the DRAM 66 is (01), the character position of the character ROM 64 in the OSD-IC 62 is (1B), the color of the character is (40), and the modification of the shadowing or the flashing of the character is (00). When the display data information of this 10 bytes 1 data is transferred from the MPU 52 to the OSD-IC 62, the OSD-IC 62 sets and outputs a character pattern on the designated position of the DRAM 66 in the designated character color.

Next, an example of the structure of the character ROM 64 in the OSD-IC 62 is described with reference to FIG. 10. The character ROM 64, for example, has a capacity of approximately 256×24×12 bits. The character ROM 64 consists of a 4 bit upper address and a 4 bit lower address, where the upper address referrers a row and the lower address refers a column in FIG. 10, and both of them are referred by hexadecimal number. Characters are assigned to elements specified by the upper and lower addresses as shown in FIG. 10. For example, the position (1B) of the character ROM 64 in the display data information shown in FIG. 9 refers "R". Also, for example, when a character "° C." is desired to be projected on the screen 60, only "A5" is required to be selected as the address.

Figure 11:
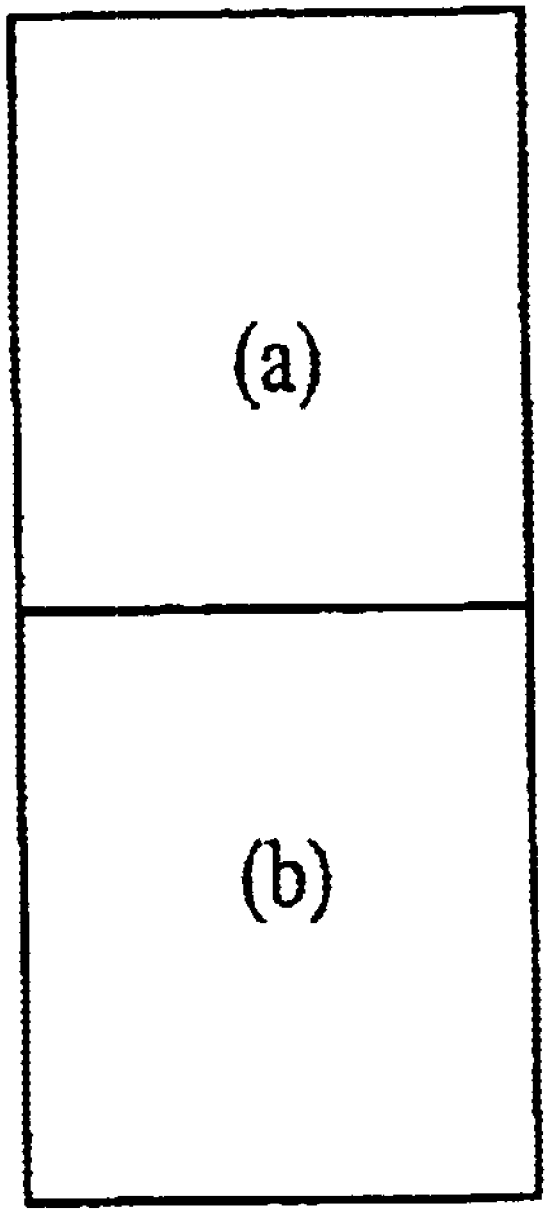
FIG. 11 is a diagram showing a structure of a ROM area on the side of the MPU 52 in the liquid crystal projector 1 according to an embodiment of the present invention.

Further, for example, when the characters "EXT Temp 25° C.", "INT Temp 35° C." are desired to be projected on the screen 60 together with the image, a memory structure shown in FIG. 11 can be previously formed at the ROM area of the MPU 52 as well. The FIG. 11 shows a plurality of character pictures and actual data corresponding to a predetermined address of the ROM area on the side of MPU 52. For example, in the above case, storing these character information, position information, and color information at addresses AD0~B1F in FIG. 11, the display on the screen 60 can be realized by transmitting a data group of these addresses AD0~B1F to the OSD-IC 62. For example, when it is selected whether the temperature is displayed at the temperature display process {4} of the operation procedure shown in FIG. 3, "Temp Monitor? YES■, NO" at the address A80~ACF at the ROM area on the side of the MPU 52 shown in FIG. 11 is selected and displayed on the screen 60. When "YES" is selected the above temperature can be displayed and when "NO" is selected, no display can be made.

Figure 12:
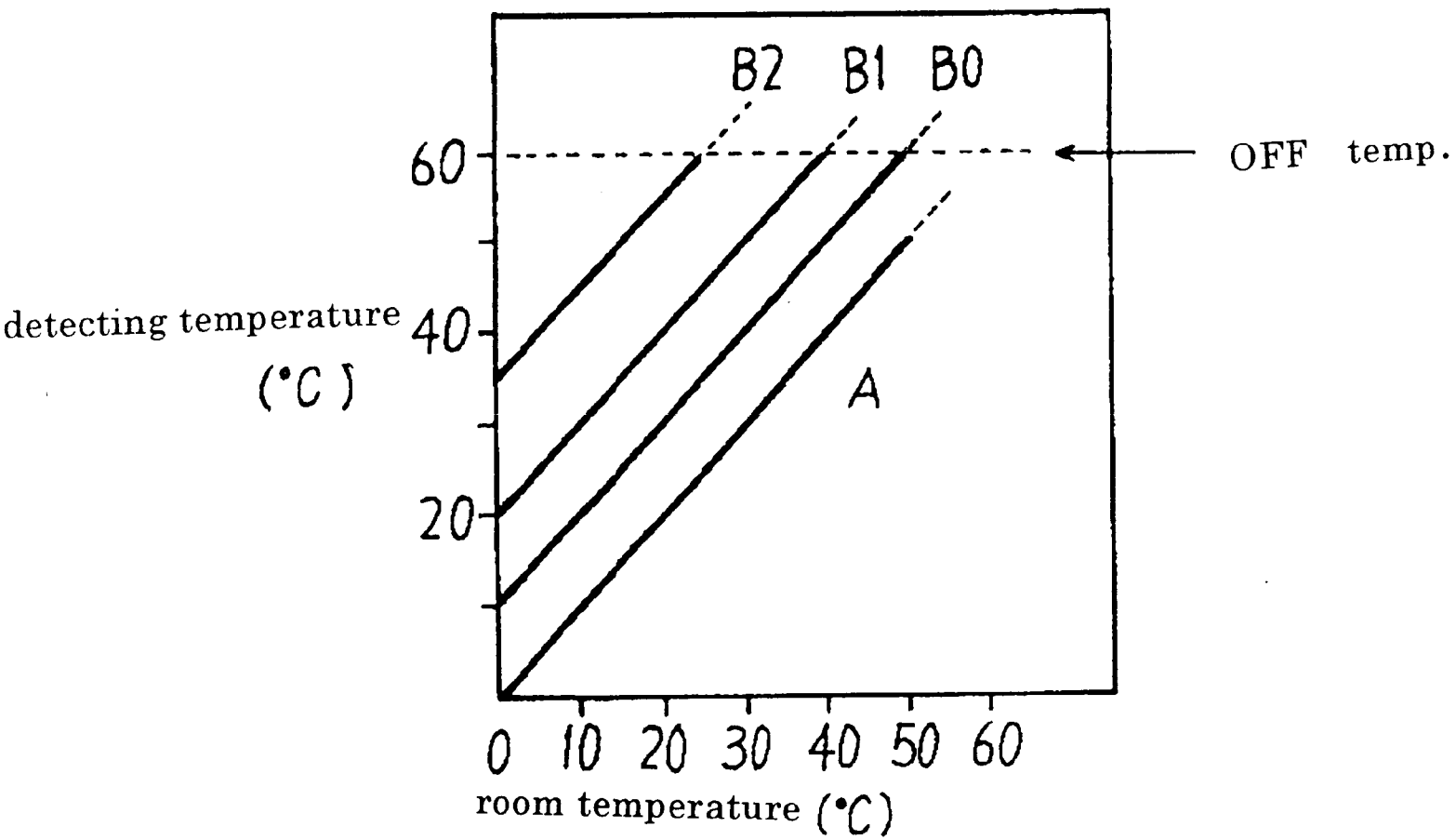
FIG. 12 is a diagram showing a relationship between internal and external temperatures of the liquid crystal projector 1 caused by the extent of the dirt of a filter 14.
Figure 15:
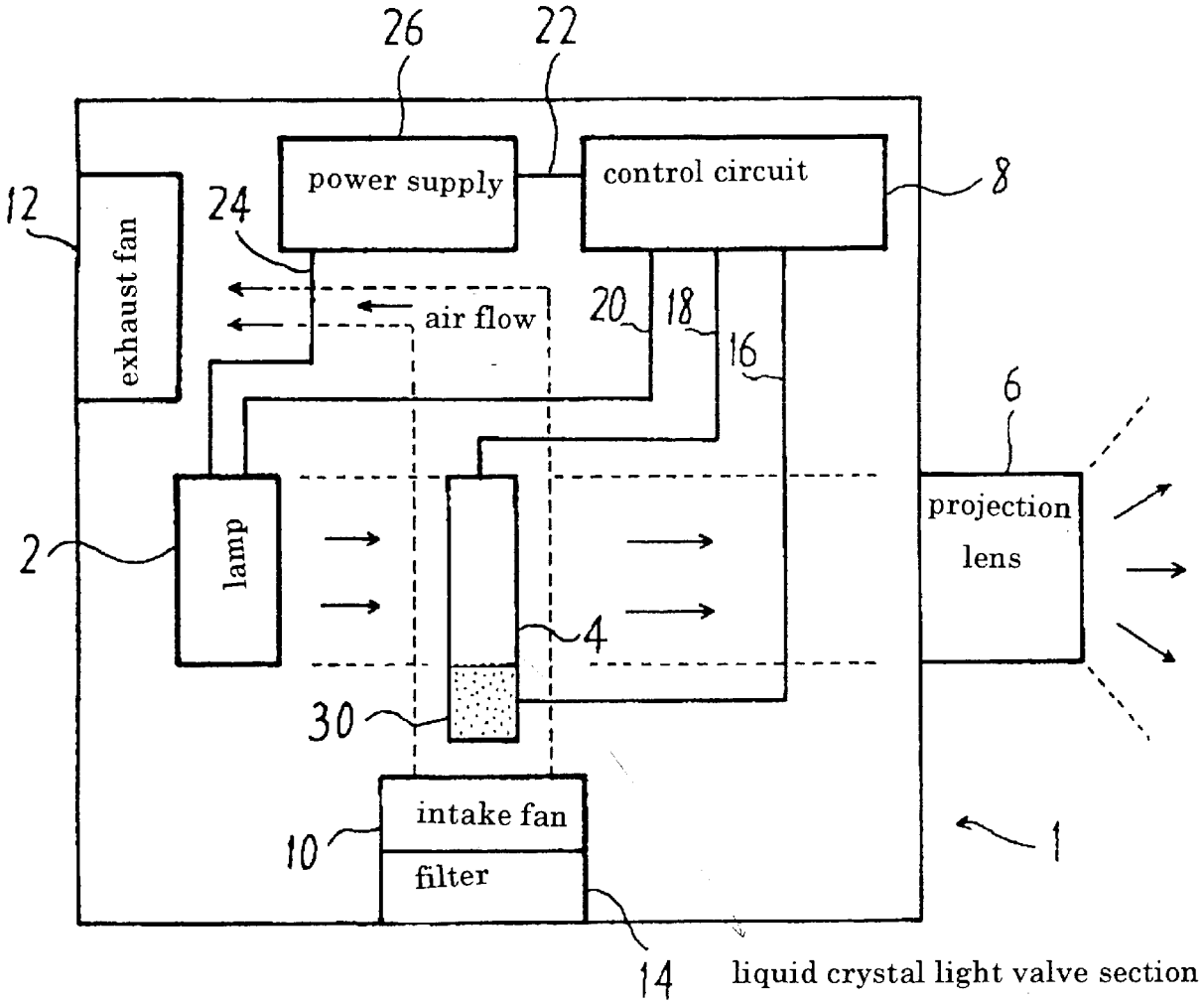
FIG. 15 is a diagram showing a schematic structure of the conventional liquid crystal projector.
Figure 1:
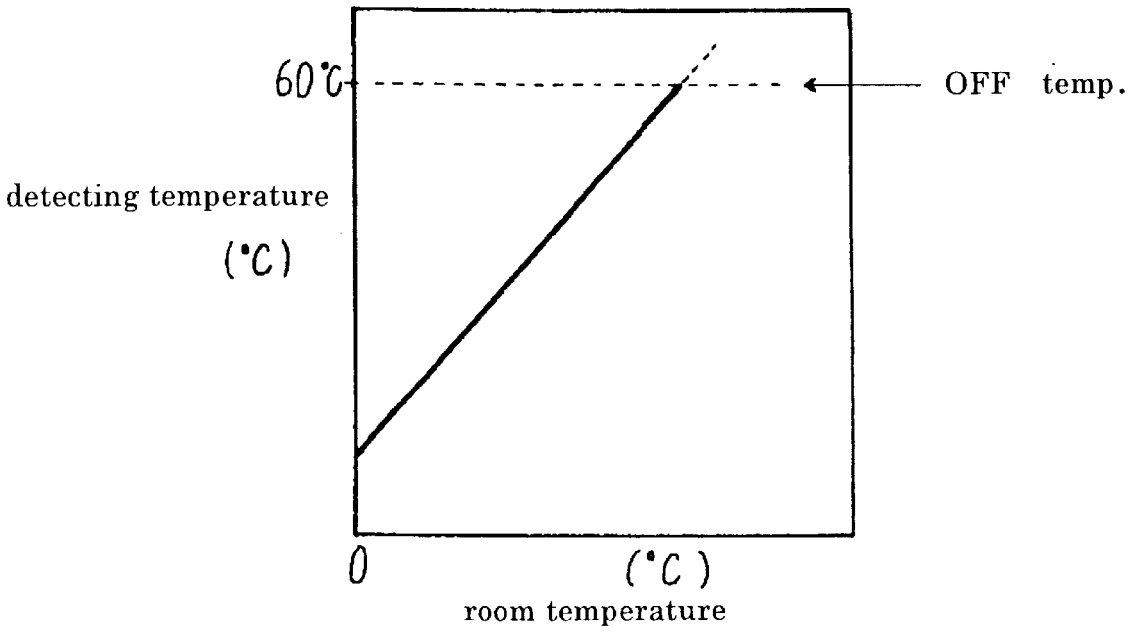

Next, the filter cleaning process {5} and the filter change process {6} are described with reference to FIG. 12 and FIG. 13. FIG. 12 shows a relationship between the external temperature and the internal temperature of the liquid crystal projector 1 regarding to the extent of the dirt of the filter 14. A lateral axis shows a room temperature (° C.) and a vertical axis shows a detection temperature (° C.) detected at the temperature detecting devices 30 and 32. "A" in FIG. 12 shows a room temperature detected at the temperature detecting device 32 and "B0, B1, and B2" respectively show a temperature on the liquid crystal panel side detected at the temperature detecting device 30 when the extent of the dirt is different. As shown by the "B0" in FIG. 12, the temperature of the liquid crystal panel side, when a new filter 14 is used, is 10° C. higher than the external temperature. The "B1" shows the temperature of the liquid crystal panel side when the dirt of the filter 14 is medium and the cleaning of the filter is required, and shows that it is 20° C. higher than the external temperature. The "B2" is the temperature of the liquid crystal panel side when the dirt of the filter 14 is severe and the change of the filter 14 is required, and shows that it is 35° C. higher than the external temperature.

Therefore, by obtaining the temperature difference detected from the temperature detecting devices 30 and 32 at the temperature control circuit 54, the extent of the dirt of the filter 14 can be assumed. The temperature control circuit 54 transmits an alarm signal to the MPU 52 based on the extent of the dirt assumed. The MPU 52 displays information such as shown in FIG. 13 responding to the received alarm signal on the screen 60 via the OSD control circuit 44, thus allowing to urge the maintenance of the filter 14 to the user. In an example in FIG. 13, though "Cleaning the Filter (Int/Ext dif 20° C.)" is displayed on the screen 60, "Changing the Filter (Int/Ext dif 35° C.)" is displayed when the temperature difference comes to approximately 35° C.

The filter cleaning process {5} is described returning to the operation flow shown in FIG. 3. To urge a necessary maintenance to the user by assuming the extent of the dirt of the filter 14, in the filter cleaning process {5}, the temperature difference between the internal temperature and the external temperature of the liquid crystal projector 1 is obtained from the detecting result of the temperature detecting devices 30 and 32 at the temperature control circuit 54 and transmitted to the MPU 52, thereby being judged whether the filter cleaning is required or not (step S20). When the temperature difference is 20° C.~35° C., "Cleaning the Filter (Int/Ext dif 20° C.)" (the character of "Cleaning" is, for example, displayed in yellow color) of the address B80~BFF at the ROM area on the MPU 52 side shown in FIG. 11 is transmitted to the OSD-IC 62 to be displayed on the screen 60 (step S21). When the temperature difference is other than 20° C.~35° C., it proceeds to the filter change process {6}.

Next, as is the case of the MPU 52, it is judged whether the filter change is required or not at the filter change process {6} (step S22). When the temperature difference between the internal temperature and the external temperature of the liquid crystal projector 1 is 35° C.~40° C., "Changing the Filter (Int/Ext dif 35° C.)" (the character of "Changing" is, for example, displayed in red color) of the address C00~C7F at the ROM area on the MPU 52 side shown in FIG. 11 is transmitted to the OSD-IC 62 to be displayed on the screen 60 (step S23). When the temperature difference is other than 35° C.~40° C., it proceeds to the extraordinary temperature monitor process {7}.

An procedure of the extraordinary temperature monitor process {7} is described next. First, studying the situation wherein the temperature in the liquid crystal projector 1 increases and exceeds the allowed temperature, thereby disconnecting the power supply 26, as described with reference to FIG. 2, the liquid crystal panel increases its temperature along with an increase in room temperature maintaining 10° C. higher than the room temperature. So, the power supply 26 is disconnected when the external temperature of the liquid crystal projector 1 continuously increases and exceeds the allowed temperature of the liquid crystal panel. However, even if no room temperature changes, for example, malfunctions such as a stop of the intake/exhaust fans 10 and 12 or a reduction of the rotating speed lead to an increase in internal temperature of the liquid crystal projector 1 and an excess over the allowed temperature of the liquid crystal panel, thereby the power supply may be disconnected.

Thus, though there are some causes for the disconnection of the power supply 26, there is a problem that it is extremely difficult to analyze the causes even if these causes are tried to be investigated in the past, because the power supply 26 in the liquid crystal projector 1 has been already disconnected. In the past, it is completely unknown whether the power supply 26 is disconnected because the external temperature of the liquid crystal projector 1 increases or the malfunction of the intake/exhaust fan 10 or 12 occurs. However, with the liquid crystal projector 1 according to this embodiment, a trouble analysis is easy because the external temperature is simultaneously measured as well. At the step S24, the temperature of the liquid crystal light valve section 4 is judged whether it is extraordinary or not. If the temperature of the liquid crystal light valve section 4 is judged via the temperature control circuit 54 that it exceeds the specified temperature, the MPU 52 memorizes values of the temperature data from the temperature detecting devices 30 and 32 at that time (step S25), disconnects the power supply 26 or the lamp 2 by controlling the power supply/lamp control circuit 56 (step S26), and stop the function (step S27). The values of the temperature data from the temperature detecting devices 30 and 32, for example, are stored behind an address C40 at the ROM area of the MPU 52 shown in FIG. 11.

After disconnecting the power supply 26 in the liquid crystal projector 1 and connecting the power supply 26 again thereafter, data behind the address C40 at the ROM area of the MPU 52 can be displayed on the screen 60 via the OSD control circuit 44 as the data at the time of the trouble occurrence as shown in FIG. 14 by instructing from the control panel or the remote control unit. FIG. 14 shows an example of a temperature condition displayed on the screen 60 when the power is disconnected. For example, they are like "Power off Temp", "EXT Temp 20° C.", "INT Temp 60° C.", "Dif 40° C." and so on.

Next, The power-off monitor process {8} in FIG. 3 is described. The power supply SW is monitored whether the power supply SW is disconnected by the control panel or the remote control unit in the power-off monitor process (step S28). When the power supply SW is disconnected, the process comes out of the loop and stops the display by disconnecting to the lamps 2 (step S29).

As has been described above, according to the liquid crystal projector 1 of this embodiment, the user side can discover a filter clogging and the like, and realize an easy maintenance.

In addition, according to the liquid crystal projector 1 of this embodiment, since not only the internal temperature of the body but also the external temperature of the body are memorized, the cause of the disconnection is easily judged whether it is due to an increase in external temperature of the display or due to the malfunction of the fan stop or the reduction of the rotating speed, thus making it easy to analyze the causes at the time of the trouble occurrence.

Also, according to the liquid crystal projector 1 of this embodiment, the internal temperature of the body, external temperature, and the time for filter cleaning or filter change can be displayed on the screen on which the picture is projected, so that an easy maintenance can be realized by the user.

Further, according to the liquid crystal projector 1 of this embodiment, even if the gradation of the picture signal emitting the light valve is under the situation to receive the influence of the temperature change of the body, the level of the modulation signal can be shifted in response to the temperature change, thus allowing to project a picture in high quality which prevents the deterioration in image quality.

The present invention can be modified in various manners without being limited to the above embodiment.

For example, in the above embodiment, though the transmission type liquid crystal light valve to project the image on the screen 60 by passing through light conducted by the dichroic mirrors and the like from the lamp 2 is used, the present invention is of course not limited to this. A reflection type liquid crystal light valve using a reflection type liquid crystal panel to project the image on the screen by reflecting the light from the light source can be also used.

As has been described above, according to the present invention, the user side can realize the projection type display which is easy to maintain. Also, according to the present invention, the projection type display which improves the picture quality can be realized. Further, according to the present invention, the projection type display which can easily analyze the causes at the time of trouble occurrence can be realized.

What is claimed is:

1. A projection type display having a light valve for modulating and emitting an incident light from a light source, a projection lens for enlarging and projecting an emitted light from the light valve, and a body at least containing the light valve comprising:

an intake fan for injecting air into the body;

a filter provided on an outside air intake side of the intake fan;

a temperature measurement unit having a first temperature detecting device to measure a temperature in the vicinity of the light valve and a second temperature detecting device being arranged in the vicinity of the intake fan to measure a temperature in the vicinity the filter; and a control system to control at least on/off a power supply of the light source based on a temperature measured by the temperature measurement unit;

wherein the control system comprises an estimation processing section which measures a temperature difference between the temperature in the vicinity of the light valve and the temperature in the vicinity of the filter based on measurement results of the first temperature detecting device and the second temperature detecting device, and presumes the extent of the dirt of the filter based on the temperature difference.

2. A projection type display as set forth in claim 1, wherein the control system comprises an on-screen display control circuit and supplies a modulation signal overlapping a predetermined image on a picture signal to the light valve.

3. A projection type display as set forth in claim 1, wherein the light valve comprises a liquid crystal panel which modulates the incident light by a picture signal and emits the incident light.

4. A projection type display having a light valve for modulating and emitting an incident light from a light source, a projection lens for enlarging and projecting an emitted light from the light valve, and a body at least containing the light valve comprising:

a temperature measurement unit for measuring at least a temperature in the vicinity of the light valve and an external temperature of the body; and a control system to control at least on/off of a power supply of the light source based on a temperature measured by the temperature measurement unit;

wherein the control system comprises a memory section to memorize a temperature measurement unit immediately before a disconnection of the power supply.

5. A projection type display as set forth in claim 4, wherein the system comprises an on-screen display control circuit and supplies a modulation signal overlapping a predetermined image on a picture signal to the light valve.

6. A projection type display as set forth in claim 4, wherein the light valve comprises a liquid crystal panel which modulates the incident light by a picture signal and emits the incident light.

* * * * *